US007090952B2

(12) United States Patent
Azuma et al.

(10) Patent No.: US 7,090,952 B2
(45) Date of Patent: Aug. 15, 2006

(54) ELECTROPHOTOSENSITIVE MATERIAL

(75) Inventors: Jun Azuma, Osaka (JP); Yukimasa Watanabe, Osaka (JP); Ayako Yashima, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 149 days.

(21) Appl. No.: 10/705,457

(22) Filed: Nov. 12, 2003

(65) Prior Publication Data

US 2004/0101771 A1 May 27, 2004

(30) Foreign Application Priority Data

Nov. 27, 2002 (JP) ..... 2002-344422

(51) Int. Cl.
*G03G 5/00* (2006.01)

(52) U.S. Cl. ..... 430/58.85; 430/59.6; 430/96

(58) Field of Classification Search ..... 430/58.85, 430/59.6, 96

See application file for complete search history.

(56) References Cited

U.S. PATENT DOCUMENTS

| | | | |
|---|---|---|---|
| 4,933,245 A | 6/1990 | Akasaki et al. | |
| 6,090,514 A | 7/2000 | Kakui et al. | |
| 6,573,017 B1 * | 6/2003 | Azuma et al. | 430/96 |

FOREIGN PATENT DOCUMENTS

| | | |
|---|---|---|
| JP | 59-071057 | 4/1984 |
| JP | 61-55672 | 11/1986 |
| JP | 63-261267 | 10/1988 |
| JP | 5-297601 | 11/1993 |
| JP | 5-341539 | 12/1993 |
| JP | 8-110646 | 4/1996 |
| JP | 9-22126 | 1/1997 |

* cited by examiner

*Primary Examiner*—Mark A. Chapman
(74) *Attorney, Agent, or Firm*—Smith, Gambrell,& Russell, LLP

(57) ABSTRACT

The present invention provides an electrophotosensitive material comprising a conductive substrate and a photosensitive layer provided on the conductive substrate, wherein the photosensitive layer contains a polyarylate having a repeating unit represented by the general formula (1):

(1)

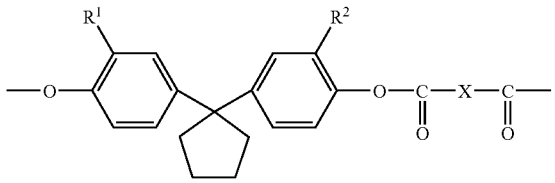

wherein X represents a phenylene group, a naphthylene group, or a biphenylene group, as a binder resin. The polyarylate is contained in the amount of 30% by weight or more based on the entire binder resin. The electrophotosensitive material of the present invention have improved wear resistance and gas resistance while reconciling both characteristics, and thus longer life has been achieved.

4 Claims, No Drawings

ELECTROPHOTOSENSITIVE MATERIAL

BACKGROUND OF THE INVENTION

The present invention relates to an electrophotosensitive material which is used in image forming apparatuses such as electrostatic copying machine, laser beam printer and facsimile and, more particularly, to an electrophotosensitive material which is excellent in durability, particularly wear resistance and gas resistance.

In image forming apparatuses such as electrostatic copying machine, facsimile and laser beam printer, electrophotosensitive materials having sensitivity in a wavelength range of a light source used in these image forming apparatuses are used. As the electrophotosensitive material, an inorganic photosensitive material having a photosensitive layer made of an inorganic material such as selenium and an organic photosensitive material (or organic photoconductor, OPC) having a photosensitive layer made of an organic conductive material are known. Among these photosensitive materials, the latter organic photosensitive material has widely been studied, recently, because it is easily produced as compared with the inorganic photosensitive material and has a wide range of choice of photosensitive materials such as electric charge transferring material, electric charge generating material and binder resin as well as high functional design freedom.

To maintain quality of the formed images in a good state for a long period in the above image forming apparatuses, it is required to enhance durability of the electrophotosensitive material to an external force applied during processes of charging, toner development, transfer onto papers and cleaning, and particularly to further improve wear resistance of a photosensitive layer.

In the organic photosensitive material, therefore, it has been studied to use a polycarbonate resin having high mechanical strength as a binder resin for formation of the photosensitive layer (see Patent Documents 1 and 2).

As typical examples of a polyallylate, which is a polyester of diphenol, "U-polymer (R)" as a condensate of bisphenol A and phthalic acid is known. It is described that this polyallylate is suited for use as a binder resin for improving the durability of the photosensitive layer because of its high heat distortion temperature and excellent mechanical properties (see Patent Document 3).

Furthermore, as a binder resin capable of forming a photosensitive layer having excellent durability as compared with the "U-polymer (R)" and polycarbonate, for example, polyallylate (Patent Documents 4 and 5) wherein a diphenol component is fluorenone type bisphenol or 1,1-bis(4-hydroxyphenyl)-1-phenylethane, or polyallylate a diphenol component is bisphenol C or 1,1-bis(4-hydroxyphenyl) cycloalkane and the resin has a viscosity within a predetermined range (Patent Documents 6 and 7) is disclosed.

Patent Document 1: Japanese Published Unexamined Patent Application (Kokai Tokkyo Koho Sho) No. 63-261267 (see claim 1)

Patent Document 2: Japanese Published Unexamined Patent Application (Kokai Tokkyo Koho Sho) No. 59-71057 (see claim 1)

Patent Document 3: Japanese Published Unexamined Patent Application (Kokoku Tokkyo Koho Sho) No. 61-55672 (see claim 1)

Patent Document 4: Japanese Published Unexamined Patent Application (Kokai Tokkyo Koho Hei) No. 5-297601 (see claim 1, Example 1 and Comparative Examples 1 to 2)

Patent Document 5: Japanese Published Unexamined Patent Application (Kokai Tokkyo Koho Hei) No. 5-341539 (see claim 1, Example 1 and Comparative Examples 1 to 2)

Patent Document 6: Japanese Published Unexamined Patent Application (Kokai Tokkyo Koho Hei) No. 9-22126 (see claim 1 and Comparative Example 3)

Patent Document 7: Japanese Published Unexamined Patent Application (Kokai Tokkyo Koho Hei) No. 8-110646 (see claim 1, paragraph [0010], paragraph [0011] and Comparative Examples 3 to 4)

However, the effect of improving the mechanical strength of the photosensitive layer is insufficient at present. Even when using the binder resins described in the above publications, the photosensitive layer causes wear within a comparatively short period when used practically in an image forming apparatus, and thus it is insufficient to achieve longer life of the electrophotosensitive material.

During charging of the electrophotosensitive material, an ozone gas or a NOx gas is sometimes evolved by corona discharge. Because of insufficient ozone gas or NOx gas shielding properties, a photosensitive material made of a conventional binder resin causes a problem wherein chargeability of the photosensitive material is deteriorated by exposure to the gas for a long time, namely, deterioration of charge stability during repeated exposure.

SUMMARY OF THE INVENTION

An object of the present invention is to provide an electrophotosensitive material which can achieve longer life by improving wear resistance and gas resistance while reconciling both characteristics.

To achieve the above object, the electrophotosensitive material of the present invention is an electrophotosensitive material comprising a conductive substrate and a photosensitive layer provided on the conductive substrate, wherein the photosensitive layer contains a polyarylate having a repeating unit represented by the general formula (1):

(1)

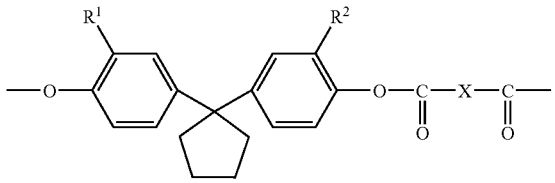

in the formula (1), X represents any of divalent groups represented by the formulas (a) to (c):

(a)

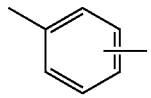

(b)

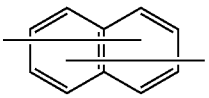

-continued (c)

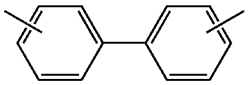

and $R^1$ and $R^2$ are the same or different and represent an alkyl group having 1 to 3 carbon atoms.

In the electrophotosensitive material of the present invention, since a polyarylate having a specific repeating unit represented by the above formula is used as the binder resin for formation of the photosensitive layer, the photosensitive layer has very high wear resistance and causes less wear even when used repeatedly in an image forming apparatus, and thus longer life of the material can be achieved.

Moreover, the polyarylate having a specific repeating unit is excellent in gas resistance and is suited to achieve longer life of the electrophotosensitive material.

As described above, Patent Document 7 discloses 1,1-bis (4-hydroxyphenyl) cycloalkane as a dihydric phenol moiety of the polyallylate and also discloses cyclopentane as specific examples of the cycloalkane (see paragraphs [0010] and [0011]). Also the same document discloses, as a group corresponding to x in the general formula (1), phenylene group, biphenylene group and naphthylene group, similar to the case of the general formula (1) (see claim 1).

However, the document merely describes, as a specific compound (dihydric phenol moiety) in case the cycloalkane is cyclopentane, 1,1-bis(4-hydroxyphenyl)-3,3-dimethyl-5-methylcyclopentane [1,1-bis(4-hydroxyphenyl)-2,4,4-trimethylcyclopentane, see the following formula (81)] and 1,1-bis(4-hydroxyphenyl)cyclopentane (see the following formula (82)) (see paragraphs [0010] and [0011]).

(81)

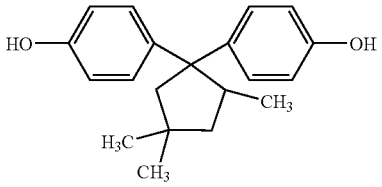

(82)

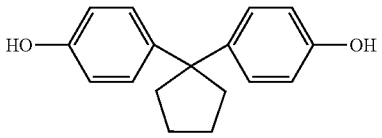

In case the dihydric phenol moiety is represented by the formula (81) or (82), namely, a group (an alkyl group having 1 to 3 carbon atoms) corresponding to $R^1$ and $R^2$ does not exist in the repeating unit represented by the general formula (1), as is apparent from the results of the Examples and Comparative Examples described hereinafter, it becomes difficult to form a uniform photosensitive layer because of poor solubility to a solvent for formation of the photosensitive layer.

The electrophoto sensitive material of the present invention may contain the polyarylate having a repeating unit represented by the general formula (1) is in the amount of 30% by weight or more, and preferably 40% by weight or more, based on the entire binder resin for formation of the photosensitive layer.

In the electrophotosensitive material of the present invention, the substituents $R^1$ and $R^2$ in the repeating unit represented by the general formula (1) are preferably methyl groups. That is, the polyarylate used in the present invention preferably has a repeating unit represented by the general formula (1').

(1')

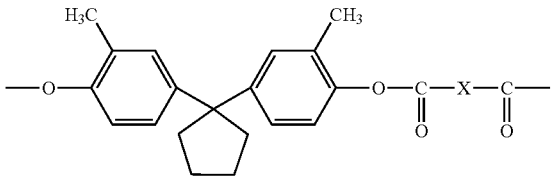

As shown in the general formula (1 '), incase the substituents $R^1$ and $R^2$ of the repeating unit (1) are alkyl groups having 1 to 3 carbon atoms, the solubility of the polyarylate having the repeating unit to the solvent used in the coating solution for formation of a photosensitive layer is improved. The smaller the bulk of the substituents $R^1$ and $R^2$ (namely, the smaller the number of carbon atoms of the alkyl group), the more, gas resistance and wear resistance of the photosensitive material can be further improved.

The electrophotosensitive material of the present invention preferably comprises:

(I) an electrophotosensitive material comprising a photosensitive layer of a single layer, said layer containing a polyarylate having a repeating unit represented by the general formula (1) and at least an electric charge generating material and an electric charge transferring material, or (II) an electrophotosensitive material comprising a photosensitive layer of a laminate composed of two or more layers, a layer containing a polyarylate having a repeating unit represented by the general formula (1) among two or more layers being an outermost layer of the photosensitive layer and also being a layer containing no electric charge generating material.

Both of the electrophotosensitive materials (I) and (II) are preferable aspects of the present invention and the electrophotosensitive material (I) is a single-layer type electrophotosensitive material, while the electrophotosensitive material (II) is a multi-layer type electrophotosensitive material.

Since the polyarylate having a repeating unit represented by the general formula (1) used as the binder resin in the electrophotosensitive material of the present invention has a feature capable of improving durability of the photosensitive layer, particularly wear resistance and gas resistance, the above polyarylate may be used as the binder resin of the layer present on the surface side of the photosensitive material (outer layer) in the multi-layer type photosensitive material. The binder resin in the inner layer of the photosensitive material may be replaced by the other binder resin or a binder resin whose content is increased when blended with the polyarylate, taking account of matching or solubility with the electric charge generating material or the electric charge generating material.

In the electrophotosensitive material of the present invention, the photosensitive layer contains the polyarylate having a repeating unit represented by the general formula (1) and a hole transferring material and the hole transferring material has a triphenylaminostyryl group represented by the general formula (h1):

(h1)

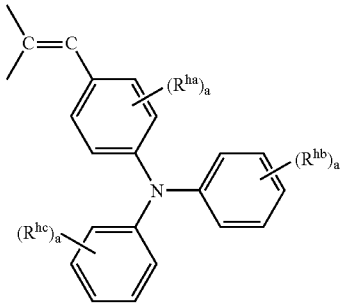

in the formula (h1), $R^{ha}$ to $R^{hc}$ are the same or different and represent an alkyl group having 1 to 8 carbon atoms, an alkoxy group having 1 to 8 carbon atoms, or an aryl group having 12 or less carbon atoms and, in case two or more of the substituents $R^{ha}$ to $R^{hc}$ are substituted on the same benzene ring, the substituents $R^{ha}$ to $R^{hc}$ substituted on adjacent carbon atoms may be combined with each other to form a saturated or unsaturated hydrocarbon ring, and a represents an integer of 0 to 3, in the molecule.

Since the hole transferring material is particularly excellent in matching with the polyarylate having a repeating unit represented by the general formula (1), it is more preferably to use the both in combination so as to improve the sensitivity of the electrophotosensitive material.

DETAILED DESCRIPTION OF THE INVENTION

The electrophotosensitive material of the present invention will be described in detail below.

[Binder Resin]

As described above, the binder resin used in the electrophotosensitive material of the present invention contains a polyarylate having a repeating unit represented by the general formula (1). The content of the polyarylate is 30% by weight or more, and preferably 40% by weight or more, based on the entire binder resin for formation of the photosensitive layer.

A viscosity-average molecular weight [Mv] of the polyarylate having the repeating unit (1) is preferably from 5,000 to 200,000, and more preferably from 15,000 to 100,000, in terms of bisphenol A type polycarbonate.

Specifically, the repeating unit (1) is represented by any one of the general formulas (11) to (13):

(11)

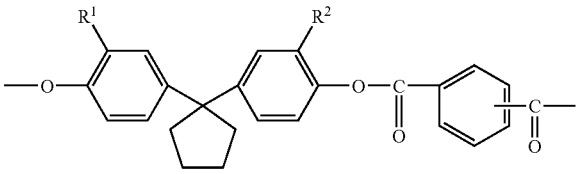

-continued (12)

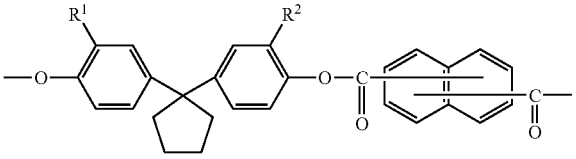

(13)

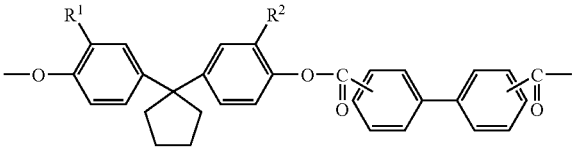

in the formulas (11) to (13), $R^1$ and $R^2$ are as defined above.

As described above, $R^1$ and $R^2$ of the repeating units (11) to (13) are more preferably methyl groups.

The polyarylate having the repeating unit is excellent in compatibility between the electric charge generating material and the electric charge transferring material and does not contain a portion, which adversely affect electric charge transferrability of the electric charge transferring material, in the molecule. Therefore, when electrophotosensitive material contains the polyarylate as the binder resin, there can be exerted the effect of achieving longer life by improving wear resistance and gas resistance of the electrophotosensitive material while reconciling both characteristics.

In the electrophotosensitive material of the present invention, as the binder resin, the above polyarylate having the repeating unit may be used in combination with at least one resin selected from the group consisting of polycarbonate, polyester, polyarylate having the other repeating unit of the general formula (1), polystyrene and polymethacrylate ester.

[Electric Charge Generating Material]

Examples of the electric charge generating material, which can be used in the electrophotosensitive material of the present invention, include conventionally known various electric charge generating materials, for example, phthalocyanine pigments such as metal-free phthalocyanine ($H_2$ Pc) represented by the formula (CGM1):

(CGM1)

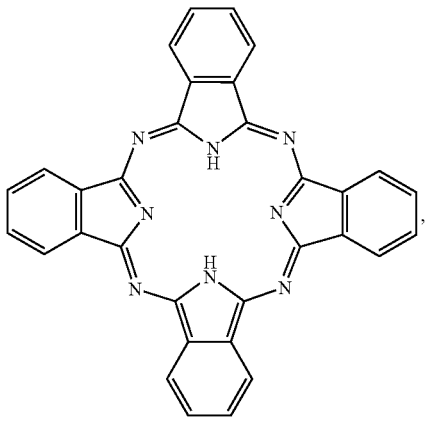

titanylphthalocyanine (TiOPc) represented by the formula (CGM2):

(CGM2)

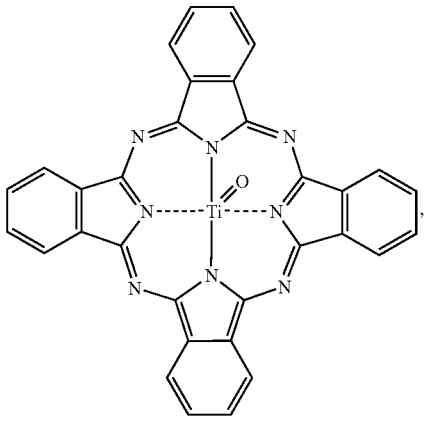

hydroxygalliumphthalocyanine represented by the formula (CGM3):

(CGM3)

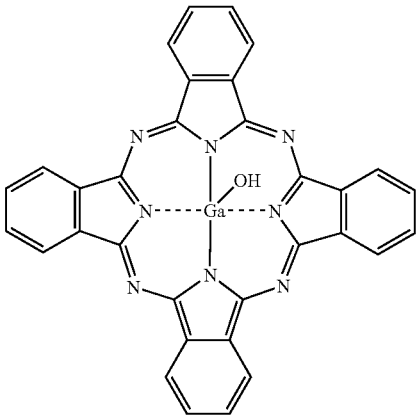

and chlorogalliumphthalocyanine represented by the formula (CGM4):

(CGM4)

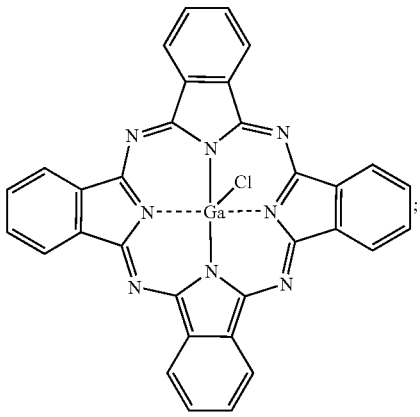

disazo pigments, disazo condensed pigments, monoazo pigments, perylene pigments, dithioketopyrrolopyrrole pigments, metal-free naphthalocyanine pigments, metallic naphthalocyanine pigments, squaline pigments, trisazo pigments, indigo pigments, azulenium pigments, cyanine pigments, pyrylium salts, anthanthrone pigments, triphenylmethane pigments, threne pigments, toluidine pigments, pyrrazoline pigments, and quinacridone pigments.

To improve characteristics such as dispersibility in the binder resin of the electric charge generating material, the electrophotosensitive material may contain azo pigments such as C.I. Pigment Orange 16 represented by the formula (Pig 1):

(Pig1)

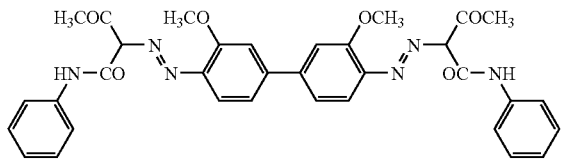

The electric charge generating material may be selected from those described above so that the electrophotosensitive material has sensitivity in the desired absorption wavelength range. These electric charge generating materials may be used alone, or two or more kinds of them may be used in combination.

Digital optical image forming apparatus, for example, laser beam printer using a semiconductor laser and facsimile require a photosensitive material having sensitivity within a wavelength range of 600 nm or higher among the above electric charge generating materials. Therefore, phthalocyanine pigments such as metal-free phthalocyanine (CGM1) and titanyl phthalocyanine (CGM2) are preferably used.

The crystal form of the phthalocyanine pigments is not specifically limited and phthalocyanine pigments having various crystal forms can be used. As the metal-free phthalocyanine (CGM1), those having X type or I type crystal form are used. As the titanyl phthalocyanine (CGM2), those having a type [having principal diffraction peaks at Bragg angle (2Θ±0.2°) of 7.6° and 28.6° in an x-ray diffraction spectrum] or Y type [having a principal diffraction peak at Bragg angle (2Θ±0.2°) of 27.2° in an X-ray diffraction spectrum] crystal form are used. As the hydroxygalliumphthalocyanine (CGM3), those having V type crystal form are used. As the chlorogalliumphthalocyanine (CGM4), those having II type crystal form used. The phthalocyanine pigments having these crystal form are preferable in order to further improve the sensitivity of the photosensitive material.

In analog optical image forming apparatuses, for example, electrostatic copying machine using a white light source such as halogen lamp, perylene and bisazo pigments having sensitivity in a visible range are preferably used among the above electric charge generating materials.

[Electric Charge Transferring Material]

Examples of the electric charge transferring material used in the electrophotosensitive material of the present invention include conventionally known electron transferring materials and/or hole transferring materials.

Selection of the use or either (or both) of the electron transferring material and the hole transferring material may be decided according to the layer structure and charge polarity of the photosensitive material. In a single-layer type electrophotosensitive material, if a charge transfer complex is not produced between the electron transferring material and the hole transferring material, a mixture of both materials is preferably incorporated into the photosensitive layer.

(Electron Transferring Material)

Examples of the electron transferring material, which can be used in the electrophotosensitive material of the present invention, include conventionally known various electron transferring materials. Among these electron transferring materials, diphenoquione derivatives represented by the following general formulas (ETM1) and (ETM2), a stilbenequione derivative represented by the following general formula (ETM3), naphthoquinone derivatives represented by the following general formulas (ETM4), (ETM5), (ETM6) and (ETM7), dinaphthoquinone derivatives represented by the following general formulas (ETM8) and (ETM9), azoquinone derivatives represented by the following general formulas (ETM10), (ETM11), (ETM12) and (ETM13), a dimide naphthalenetetracarboxylate derivative represented by the following general formulas (ETM14), and silacyclopentadiene derivatives represented by the following general formulas (ET15) are preferable.

(ETM1)

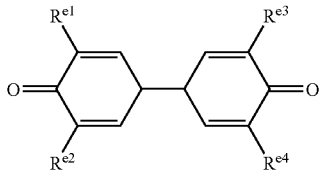

(ETM2)

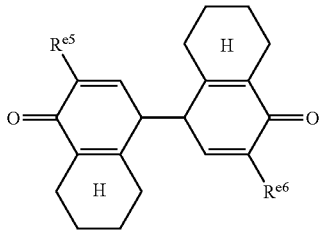

(ETM3)

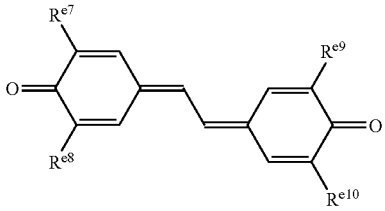

(ETM4)

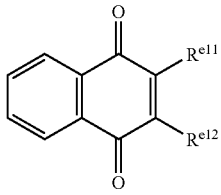

(ETM5)

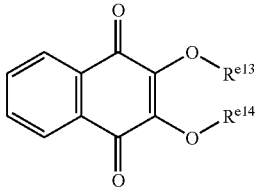

-continued (ETM6)

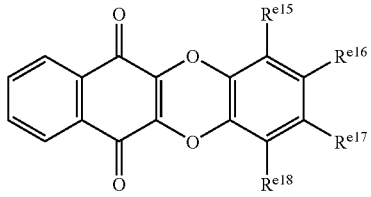

(ETM7)

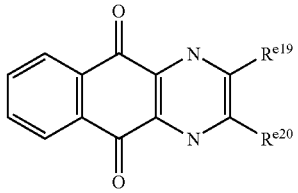

(ETM8)

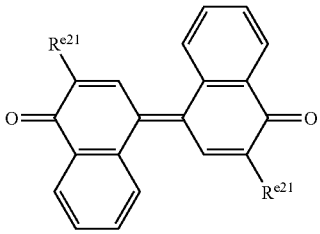

(ETM9)

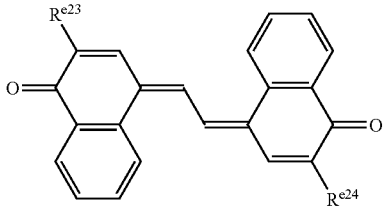

(ETM10)

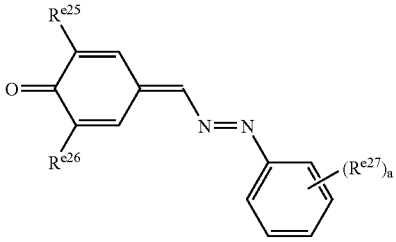

(ETM11)

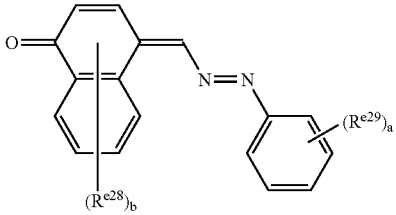

(ETM12)

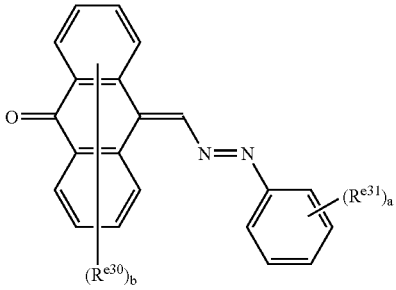

-continued (ETM13)

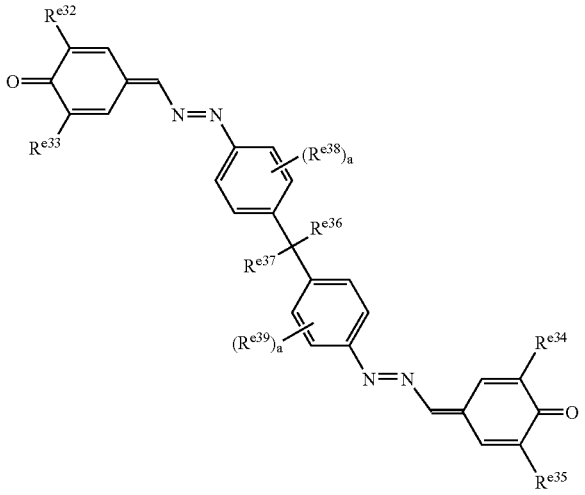

(ETM14)

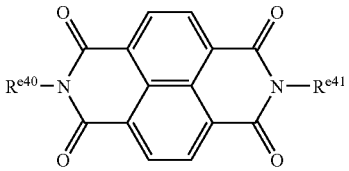

(ETM15)

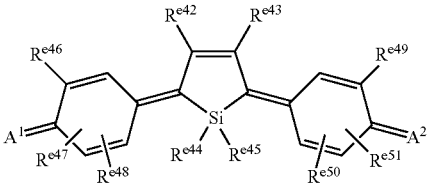

In the formulas (ETM1) to (ETM15), $R^{e1}$ to $R^{e11}$, $R^{e13}$ to $R^{e26}$, $R^{e32}$ to $R^{e37}$, $R^{e40}$ and $R^{e41}$ are the same or different and represent a hydrogen atom, an alkyl group having 1 to 8 carbon atoms, or an aryl group having 12 or less carbon atoms. $R^{e12}$ represents a hydrogen atom, an alkyl group having 1 to 8 carbon atoms, an aryl group having 12 or less carbon atoms, an alkylcarbonyl group having 1 to 9 carbon atoms, an alkoxycarbonyl group having 1 to 9 carbon atoms, an arylcarbonyl group having 13 or less carbon atoms, or an aryloxycarbonyl group having 13 or less carbon atoms. $R^{e27}$, $R^{e29}$ and $R^{e31}$ are the same or different and represent an alkyl group having 1 to 8 carbon atoms, an aryl group having 12 or less carbon atoms, a chlorine atom, or a nitro group. $R^{e28}$, $R^{e30}$, $R^{e38}$ and $R^{e39}$ are the same or different and represent an alkyl group having 1 to 8 carbon atoms or an aryl group having 12 or less carbon atoms. $A^1$ and $A^2$ are the same or different and represent =O, $=C(COOR^{11})_2$ or $=C(CN)_2$. $R^{e42}$ to $R^{e51}$ are the same or different and represent a hydrogen atom, an alkyl group having 1 to 8 carbon atoms, an alkoxy group having 1 to 8 carbon atoms, a fluoroalkyl group having 1 to 8 carbon atoms, or an aryl group having 12 or less carbon atoms. $R^{e52}$ represents an alkyl group having 1 to 8 carbon atoms or a fluoroalkyl group having 1 to 8 carbon atoms. a represents an integer of 0 to 3 and b represents an integer of 0 to 4.

These electron transferring materials may be used alone, or two or more kinds of them may be used in combination.

(Hole Transferring Material)

Examples of the hole transferring material, which can be used in the electrophotosensitive material of the present invention, include conventionally known various hole transferring materials. Among these hole transferring materials, a bisstilbenediamine derivative represented by the following general formula (HTM1), a bistriphenylamine derivative represented by the following general formula (HTM2), a triphenylaminostyryl derivative represented by the following general formula (HTM3), and a stilbeneamine-hydrazone derivative represented by the following general formula (HTM4) are preferably used.

(HTM1)

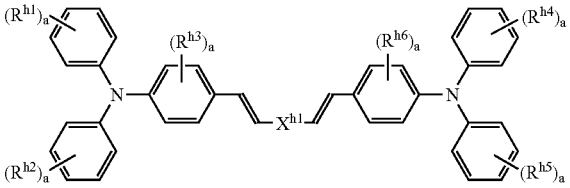

(HTM2)

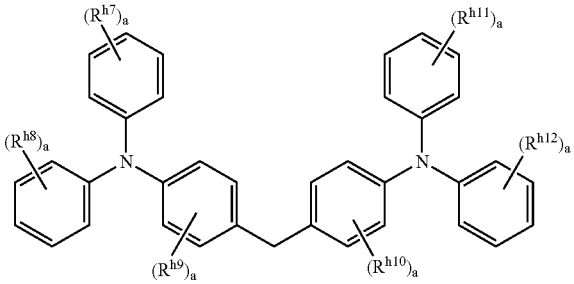

$X^{h1}$ of the formula (HTM1) represents any of the following formulas (A) to (C) and $X^{h2}$ of he formula (HTM2) represents any of the following formulas (A) to (D).

(A)

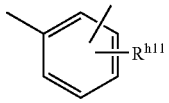

(B)

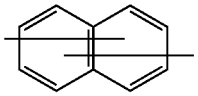

(C)

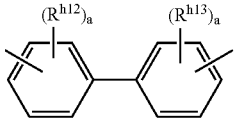

(D)

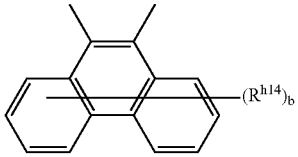

-continued (HTM3)

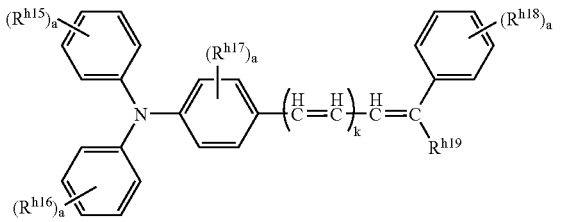

(HTM4)

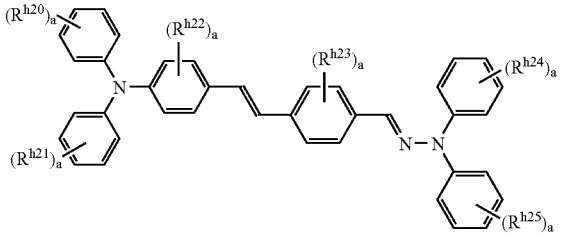

In the formula (HTM1) to (HTM4), $R^{h1}$ to $R^{h18}$ and $R^{h20}$ to $R^{h25}$ are the same or different and represent an alkyl group having 1 to 8 carbon atoms, an alkoxy group having 1 to 8 carbon atoms, or an aryl group having 12 or less carbon atoms. $R^{h19}$ represents hydrogen atom, an alkyl group having 1 to 8 carbon atoms, or an aryl group having 12 or less carbon atoms. a and b are as defined above. k represents an integer of 0 to 3.

These hole transferring materials are characterized in that they have particularly high electric charge transferrability and are less likely to form a charge transfer complex between the hole transferring material and the electron transferring material, and are also excellent in compatibility with a binder resin such as polyarylate having a repeating unit represented by the general formula (1).

Among these hole transferring materials, those having a triphenylaminostyryl group represented by the formula (h1) in the molecule (those represented by the general formulas (HTM1), (HTM3) and (HTM4)) are more preferable.

These hole transferring materials may be used alone, or two or more kinds of them may be used in combination.

[Dispersion Medium]

In the electrophotosensitive material of the present invention, examples of a dispersion medium used to prepare a coating solution by dispersing and dissolving the respective components such as electric charge generating material, electric charge transferring material and binder resin therein include various organic solvents which have conventionally been used as a solvent of a coating solution for formation of a photosensitive layer. Examples of the organic solvent include alcohols such as methanol, ethanol, isopropanol, and butanol; aliphatic hydrocarbons such as n-hexane, octane, and cyclohexane; aromatic hydrocarbons such as benzene, toluene, and xylene; halogenated hydrocarbons such as dichloromethane, dichloroethane, chloroform, carbon tetrachloride, and chlorobenzene; ethers such as dimethyl ether, diethyl ether, tetrahydrofuran, dioxane, dioxolane, ethylene glycol dimethyl ether, and diethylene glycol dimethyl ether; ketones such as acetone, methyl ethyl ketone, and cylohexanone; esters such as ethyl acetate and methyl acetate; and dimethylformaldehyde, dimethylformamide and dimethyl sulfoxide.

In the present invention, among these organic solvents, at least one organic solvent selected from the group consisting of tetrahydrofuran, dioxane, dioxolane, cyclohexanone, toluene, xylene, dichloromethane, dichloroethane and chlorobenzene is preferably used in order to stably disperse the respective components such as electric charge generating material, electric charge transferring material and binder resin, but is not specifically limited.

[Other Components]

In addition to the respective components described above, conventionally known various additives such as oxidation inhibitors, radical scavengers, singlet quenchers, antioxidants (e.g. ultraviolet absorbers), softeners, plasticizers, surface modifiers, excipients, thickeners, dispersion stabilizers, waxes, acceptors and donors can be incorporated into the coating solution for formation of a photosensitive layer as far as electrophotographic characteristics are not adversely affected. For the purpose of improving the sensitivity of the photosensitive layer, known sensitizers such as terphenyl, halonaphthoquinones and acenaphthylene may be used in combination with the electric charge generating material. To improve the dispersibility of the electric charge transferring material and electric charge generating material and the smoothness of the surface of the photosensitive layer, surfactants and leveling agents maybe added.

[Conductive Substrate]

As the conductive substrate on which the photosensitive layer is formed, for example, various materials having the conductivity can be used. The substrate includes, for example, conductive substrates made of metallic simple substances such as iron, aluminum, copper, tin, platinum, silver, vanadium, molybdenum, chromium, cadmium, titanium, nickel, palladium, indium, stainless steel and brass; substrates made of plastic materials prepared by depositing or laminating the above metals; substrates made of glasses coated with aluminum iodide, tin oxide and indium oxide; and resin substrates containing fine conductive particles such as carbon black particles dispersed therein.

The conductive substrate may be in the form of a sheet or drum according to the structure of the image forming apparatus to be used. The substrate itself may have the conductivity, or the surface of the substrate may have the conductivity. The conductive substrate may be preferably those having a sufficient mechanical strength during service.

[Process for Producing Electrophotosensitive Material]

The method of forming a photosensitive layer in the electrophotosensitive material of the present invention differs according to the case of a so-called single-layer type photosensitive material wherein an electric charge generating material and an electric charge transferring material are incorporated in the same layer, and a multi-layer type photosensitive material wherein a layer containing an electric charge generating material (electric charge generating layer) and a layer containing an electric charge transferring material (electric charge transferring layer) are separated. Any photosensitive layer is formed by dissolving and dispersing a binder resin containing a polyallylate having a repeating unit represented by the general formula (1) and components for formation of the photosensitive layer, for example, electric charge generating material and electric charge transferring material in a solvent, applying the resulting coating solution on a conductive substrate (directly or via an under coat layer) and drying the coating solution.

(Process for Producing Single-Layer Type Electrophotosensitive Material)

The single-layer type electrophotosensitive material is obtained by dispersing or dissolving an electric charge generating material, an electron transferring material, a binder resin and, if necessary, a hole transferring material and other components in a proper dispersion medium, applying the resulting coating solution for formation of a photosensitive layer on a conductive substrate, and drying the coating solution to form a photosensitive layer.

In the coating solution for formation of the photosensitive layer, the electric charge generating material maybe incorporated in the amount within a range from 0.1 to 50 parts by weight, and preferably form 0.5 to 30 parts by weight, based on 100 parts by weight of the binder resin. The electron transferring material may be incorporated in the amount within a range from 5 to 200 parts by weight, and preferably from 10 to 100 parts by weight, based on 100 parts by weight of the binder resin. The electron transferring material other than the silacyclopentadiene derivative (1) of the present invention may be incorporated as far as the effect of the present invention is not adversely affected. The hole transferring material may be incorporated in the amount within a range from 5 to 500 parts by weight, and preferably form 25 to 200 parts by weight, based on 100 parts by weight of the binder resin. When using the electron transferring material in combination with hole transferring material, the total amount of the electron transferring material and the hole transferring material is usually controlled within a range from 20 to 500 parts by weight, and preferably from 30 to 200 parts by weight, based on 100 parts by weight of the binder resin.

The thickness of the photosensitive layer formed by applying the coating solution for formation of a photosensitive layer is preferably controlled within a range from 5 to 100 μm, and particularly preferably from 10 to 50 μm.

In case of forming the photosensitive layer by the coating method, the electric charge generating material, the electric charge transferring material, the insoluble azo pigment, the binder resin and the proper solvent are dispersed and mixed using a known means such as roll mill, ball mill, attritor, paint shaker, or ultrasonic dispersing apparatus to prepare a dispersion, and then the resulting dispersion is applied by using a known means and then dried.

(Process for Producing Multi-Layer Type Electrophotosensitive Material)

In the production of a multi-layer type electrophotosensitive material, first, an electric charge generating material, a binder resin and, if necessary, other components are dispersed or dissolved in a proper solvent, and then the coating solution for formation of an electric charge generating layer is applied on a conductive substrate and dried to form an electric charge generating layer. Then, an electric charge transferring material (at least one of an electron transferring material and a hole transferring material), a binder resin and, if necessary, other components are dispersed or dissolved in a proper solvent and the resulting coating solution for formation of an electric charge transferring layer is applied on the electric charge generating layer and then dried to form an electric charge transferring layer. Thus, an electrophotosensitive material comprising a conductive substrate and an electric charge generating layer and an electric charge transferring layer laminated on the conductive substrate in this order can be obtained.

The order of lamination of the electric charge generating layer and the electric charge transferring layer may be reverse to the above order. Since the electric charge generating layer has a small thickness and is insufficient in strength, the electric charge generating layer and the electric charge transferring layer are preferably laminated in this order.

Although it is not specifically limited in single-layer type and multi-layer type electrophotosensitive materials of the present invention, an under coat layer (barrier layer) maybe formed between the conductive substrate and the photosensitive layer as far as the characteristics of the photosensitive material are not adversely affected. Also a protective layer may be formed on the surface of the photosensitive material.

EXAMPLES

The following Examples and Comparative Examples further illustrate the present invention in detail.

[Synthesis of Polyarylate]

Synthesis Example 1

56.4 g (0.20 mol) of 1,1-bis(3-methyl-4-hydroxyphenyl) cyclopentane, 1.5 g (0.010 mol) of tert-butyl phenol and 16.0 g (0.40 mol) of sodium hydroxide were dissolved in 1.1 L of water and trimethylbenzylammonium chloride as a polymerization catalyst was added to the aqueous alkali solution thus obtained, followed by vigorous stirring. The amount of the polymerization catalyst was adjusted to 0.5 mol % based on 1,1-bis(3-methyl-4-hydroxyphenyl)cyclopentane.

20.2 g (0.10 mol) of terephthaloyl chloride and 20.2 g (0.10 mol) of isophthaloyl chloride were dissolved in 0.73 L of dichloromethane and the dichloromethane solution thus obtained was added to the above aqueous alkali solution while stirring, and thus the polymerization reaction was initiated. The polymerization reaction was carried out for 3 hours and the temperature of the reaction solution during the reaction was adjusted to 20° C. After 3 hours, acetic acid was added in the reaction system, thereby to terminate the polymerization reaction.

After the completion of the polymerization reaction, the reaction solution was washed with water and then slowly added in methanol while stirring after confirming that the aqueous layer is neutralized. The precipitate was collected by filtration and then dried dried to obtain 72 g of a polyarylate (resin-1) having a repeating unit represented by he following formula (11-1) and a repeating unit represented by the following formula (11-2) in a molar ratio of 1:1.

(11-1)

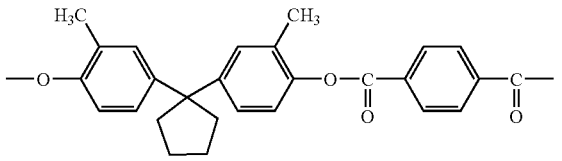

(11-2)

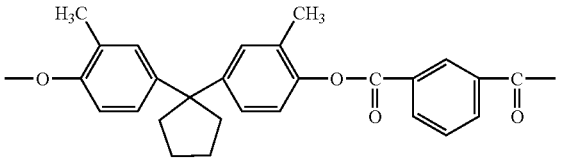

An inherent viscosity $\eta_{inh.}$ of the resulting polyarylate (resin-1) was measured by a tetrachloroethane solvent. As a result, it was 0.645.

Synthesis Example 2

In the same manner as in Synthesis Example 1, except that 15.1 g (0.06 mol) of 2,6-naphthalenedicarbonyl dichloride and 28.3 g (0.14 mol) of isophthaloyl chloride were used in place of terephthaloyl chloride and isophthaloyl chloride, a polyarylate was synthesized.

The resulting polyarylate has a repeating unit represented by the following formula (12-1) and a repeating unit represented by the above formula (11-2) in a molar ratio of 3:7.

(12-1)

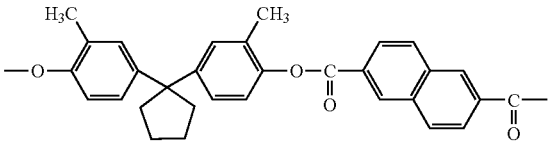

The inherent viscosity $\eta_{inh.}$ (solvent: tetrachloroethane) of the resulting polyarylate (resin-2) was 0.72.

Synthesis Example 3

In the same manner as in Synthesis Example 1, except that 55.6 g (0.20 mol) of 4,4'-biphenyldicarbonyl dichloride was used in place of terephthaloyl chloride and isophthaloyl chloride, a polyallylate was synthesized.

The resulting polyarylate has a repeating unit represented by the following formula (13-1).

(13-1)

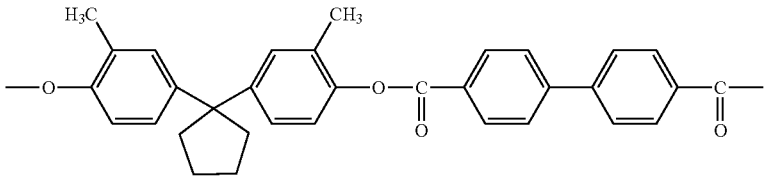

The inherent viscosity $\eta_{inh.}$ (solvent: tetrachioroethane) of the resulting polyarylate (resin-3) was 0.650.

Comparative Synthesis Example 1

In the same manner as in Synthesis Example 1, except that 45.6 g (0.20 mol) of 2,2-bis(4-hydroxyphenyl)propane was used in place of 1,1 -bis(3 -methyl-4-hydroxyphenyl)cyclopentane, a polyarylate was synthesized.

The resulting polyarylate has a repeating unit represented by the following formula (51) and a repeating unit represented by the following formula (52) in a molar ratio of 1:1.

(51)

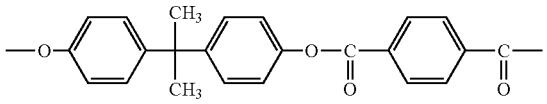

(52)

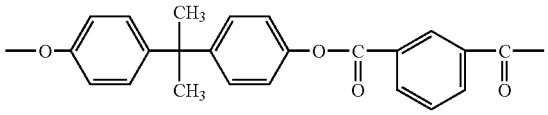

The inherent viscosity $\eta_{inh.}$ (solvent: tetrachloroethane) of the resulting polyarylate (resin-4) was 0.721.

Comparative Synthesis Example 2

In the same manner as in Synthesis Example 1, except that 50.8 g (0.20 mol) of 1,1 -bis(4-hydroxyphenyl)cyclopentane was used in place of 1,1 -bis(3-methyl-4-hydroxyphenyl) cyclopentane, a polyarylate was synthesized.

The resulting polyarylate has a repeating unit represented by the following formula (54) and a repeating unit represented by the following formula (55) in a molar ratio of 1:1.

(54)

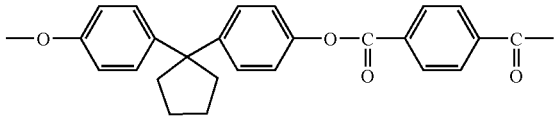

-continued (55)

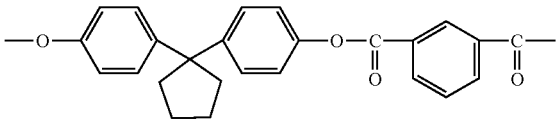

The inherent viscosity $\eta_{inh.}$ (solvent: tetrachloroethane) of the resulting polyarylate (resin-6) was 0.705.

[Production of Electrophotosensitive Material]

Example 1

3.5 Parts by weight of an X type metal-free phthalocyanine (X—$H_2$ Pc) as the electric charge generating material, 50 parts by weight of a bisstilbenediamine derivative represented by the following formula (HTM1-1) as the hole transferring material, 30 parts by weight of a diphenoquione derivative represented by the following formula (ETM14-1) as the electron transferring material, 0.1 parts by weight of a leveling agent [dimethylsilicone oil, manufactured by SHIN-ETSU CHEMICAL CO., LTD. under the trade name of "KF-96-50CS"] and 100 parts by weight of the binder resin (polyarylate (resin-1)) obtained in synthesis Example 1 were added in 600 parts by weight of a solvent (tetrahydrofuran) and then dissolved and dispersed using an ultrasonic disperser to obtain a coating solution for formation of a single-layer type photosensitive layer.

Comparative Example 1

In the same manner as in Example 1, except that the polyallylate (resin-4 obtained in Comparative Synthesis Example 1 was used as the binder resin in place of the polyallylate (resin-1) obtained in Synthesis Example 1, a single-layer type electrophotosensitive material was produced.

Comparative Example 2

In the same manner as in Example 1, except that a polycarbonate (resin-5) having a repeating unit represented by the following formula (53) was used as the binder resin in place of the polyarylate (resin-1) obtained in Synthesis Example 1, a single-layer type electrophotosensitive material was produced.

(HTM1-1)

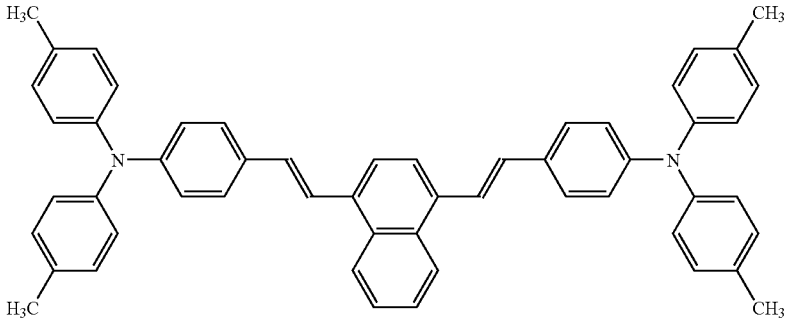

(ETM14-1)

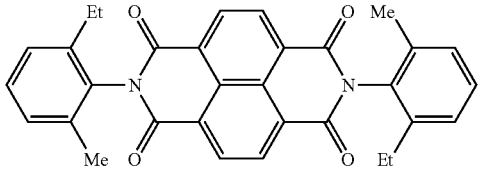

in the formula (ETM14-1), Me represents a methyl group and Et represents an ethyl group.

The above electric charge generating material is a metal-free phthalocyanine represented by the formula (CGM1), which has an X type crystal form.

Then, the above coating solution is applied on an aluminum substrate using a silicone blade and dried at 110° C. for 40 minutes to obtain an electrophotosensitive material having a 35 μm thick single-layer type photosensitive layer.

Examples 2 and 3

In the same manner as in Example 1, except that the polyarylate (resin-2) obtained in Synthesis Example 2 was used as the binder resin in place of the polyarylate (resin-1) obtained in Synthesis Example 1 in Example 2 and that the polyarylate (resin-3) obtained in Synthesis Example 3 was used in place of the polyarylate (resin-1) obtained in Synthesis Example 1 in Example 3, single-layer type electrophotosensitive materials were produced.

(53)

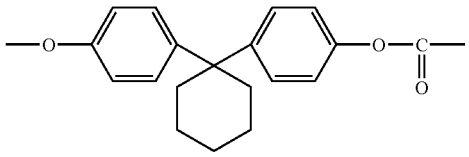

As the polycarbonate (resin-5), a polycarbonate manufactured by Mitsubishi Engineering-Plastics Corporation under the trade name of "Iupilon (R) Z-300" (viscosity-average molecular weight [Mv]: 32,000) was used.

(Evaluation of Physical Properties)

With respect to the single-layer type electrophotosensitive materials of Examples 1 to 3 and Comparative Examples 1 to 2, the following tests for evaluation of physical properties (1) and (2) were carried out.

(1) Measurement of Sensitivity Upon Positive Charging

An electrophotosensitive material was mounted to an electrostatic copying machine [manufactured by KYOCERA MITA CORPORATION under the trade name of "KM-5530"] and, after charging the surface at +800 V and exposing the surface to red semiconductor laser light having a wavelength of 780 nm, a surface potential (bright potential) was measured.

The value of the surface potential upon exposure may be +160 V or lower.

(2) Measurement of Wear Amount

After measuring the thickness of a photosensitive layer of an electrophotosensitive material, a continuous copying test of 100,000 sheets was carried out in the same manner as in a conventional copying operation, except that the electrophotosensitive material was mounted to a digital copying machine [aforementioned"KM-5530"] and paper feeding and delivering was not carried out.

After the completion of continuous printing, the electrophotosensitive material was removed from a photosensitive material drum and the thickness of the photosensitive layer was measured, and then a change in thickness before and after subjecting to continuos printing (wear amount) was calculated.

The wear amount may be 1.2 μm or less.

The results of the evaluation of physical properties with respect to Examples 1 to 3 and Comparative Examples 1 to 2 are shown in Table 1.

TABLE 1

[Single-layer type photosensitive material]
CGM: CGM1, HTM: HTM1-1, ETM: ETM14-1

| | | Evaluation of physical properties | |
|---|---|---|---|
| | Binder resin | Sensitivity upon positive charging (V) | Wear amount (μm) |
| Example 1 | Resin-1 | 136 | 1.09 |
| Example 2 | Resin-2 | 130 | 1.01 |
| Example 3 | Resin-3 | 130 | 1.02 |
| Comparative Example 1 | Resin-4 | 127 | 1.52 |
| Comparative Example 2 | Resin-5 | 127 | 1.29 |

As is apparent from Table 1, the electrophotosensitive materials of both Examples and Comparative Examples were excellent in sensitivity. With respect to the durability (wear resistance) of the photosensitive layer, the electrophotosensitive materials of the Comparative Examples exhibit large wear amount, while the electrophotosensitive materials of the Examples exhibit very small wear amount. Therefore, a difference in wear resistance between them was noticeable.

Examples 4 to 16

In the same manner as in Example 1, except that compounds shown in Table 2 were used as the electron transferring material in place of the compound represented by the formula (ETM14-1), single-layer type electrophotosensitive materials were produced.

The electron transferring materials shown in Table 2 are as follows.

(ETM1-1)

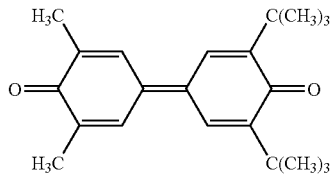

(ETM2-1)

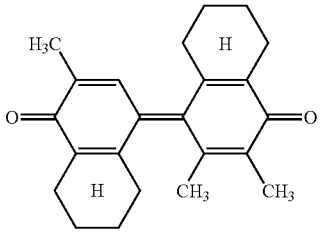

(ETM3-1)

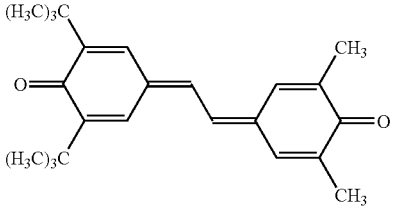

(ETM8-1)

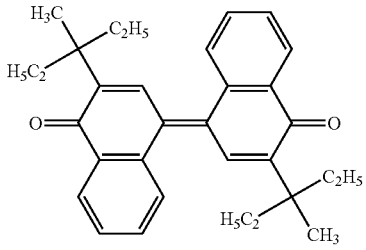

(ETM9-1)

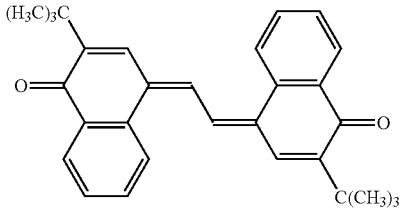

(ETM4-1)

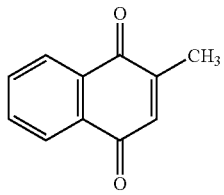

(ETM4-2)

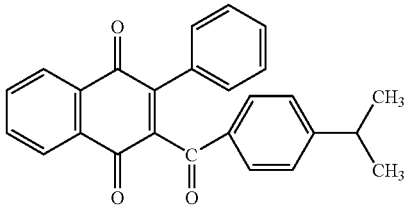

-continued (ETM4-3)

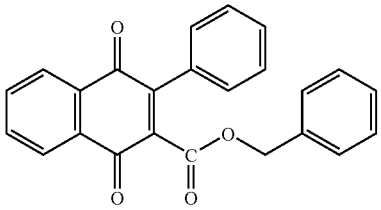

(ETM10-1)

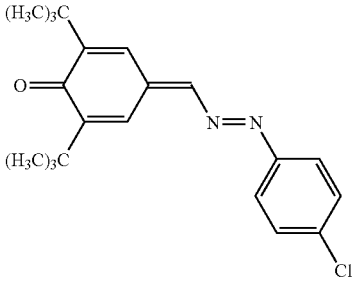

(ETM11-1)

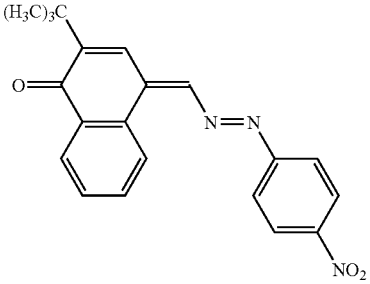

(ETM12-1)

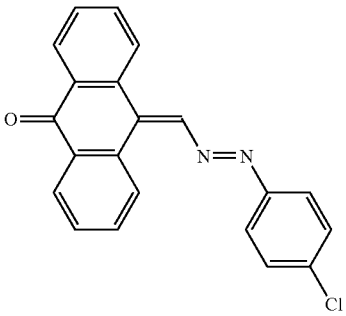

(ETM13-1)

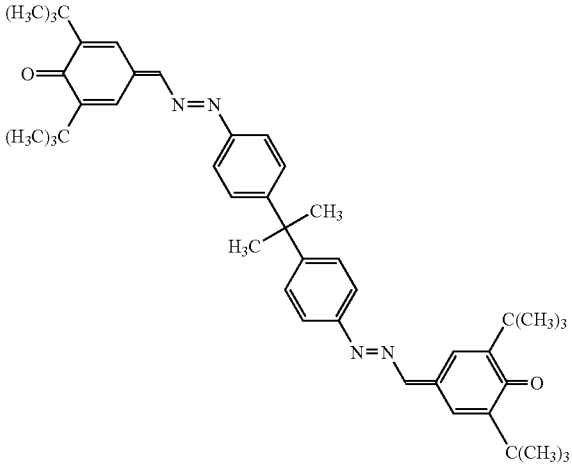

-continued (ETM15-1)

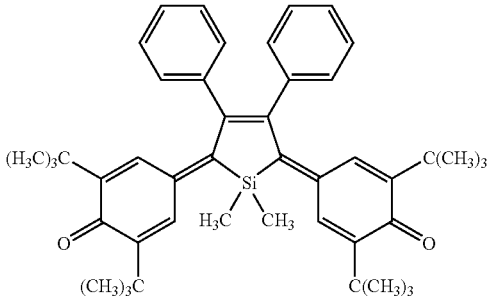

With respect to the single-layer type electrophotosensitive materials of Examples 4 to 16, the evaluation of physical properties (measurement of sensitivity upon positive charging and wear amount) was carried out in the same manner as in Example 1. The results are shown in Table 2.

TABLE 2

[Single-layer type photosensitive material]
CGM: CGM1, HTM: HTM1-1

| | Photosensitive layer-forming material | | Evaluation of physical properties | |
|---|---|---|---|---|
| | Binder resin | ETM | Sensitivity upon positive charging (V) | Wear amount (μm) |
| Example 1 | Resin-1 | ETM14-1 | 136 | 1.09 |
| Example 4 | Resin-1 | ETM1-1 | 146 | 1.01 |
| Example 5 | Resin-1 | ETM2-1 | 140 | 1.09 |
| Example 6 | Resin-1 | ETM3-1 | 130 | 1.02 |
| Example 7 | Resin-1 | ETM8-1 | 129 | 1.05 |
| Example 8 | Resin-1 | ETM9-1 | 128 | 1.11 |
| Example 9 | Resin-1 | ETM4-1 | 155 | 1.11 |
| Example10 | Resin-1 | ETM4-2 | 144 | 1.14 |
| Example 11 | Resin-1 | ETM4-3 | 142 | 1.09 |
| Example 12 | Resin-1 | ETM10-1 | 136 | 1.00 |
| Example 13 | Resin-1 | ETM11-1 | 136 | 1.00 |
| Example 14 | Resin-1 | ETM12-1 | 132 | 1.04 |
| Example 15 | Resin-1 | ETM13-1 | 145 | 1.13 |
| Example 16 | Resin-1 | ETM15-1 | 132 | 1.07 |

As is apparent from Table 2, the electrophotosensitive materials of all Examples were excellent in sensitivity and durability (wear resistance).

Examples 17 to 22 and Comparative Example 3 to 6

In Examples 17 to 22, single-layer type electrophotosensitive materials were produced in the same manner as in Example 1, except that compounds shown in Table 3 were used as the hole transferring material in place of the compound represented by the formula (HTM1-1).

In Comparative Example 3 to 6, single-layer type electrophotosensitive materials were produced in the same manner as in Example 1, except that a compound represented by the following formula (HTM5-2) or (HTM5-3) was used as the hole transferring material and the polyarylate (resin-4) or the polyarylate (resin-5) was used as the binder resin.

The hole transferring materials shown in Table 3 are as follows.

(HTM1-2)

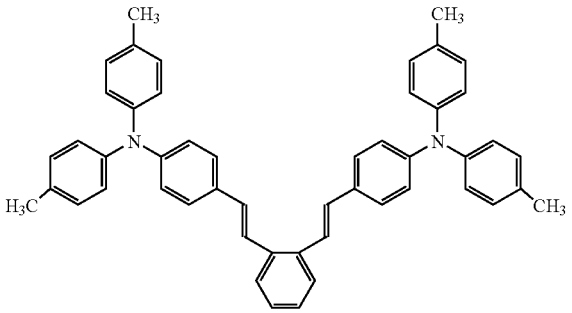

(HTM3-1)

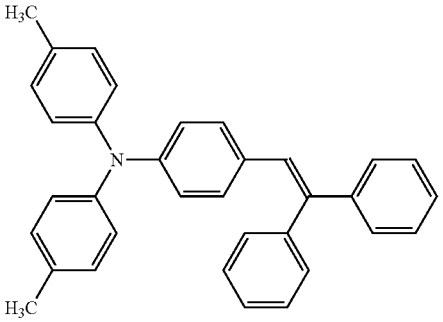

(HTM4-1)

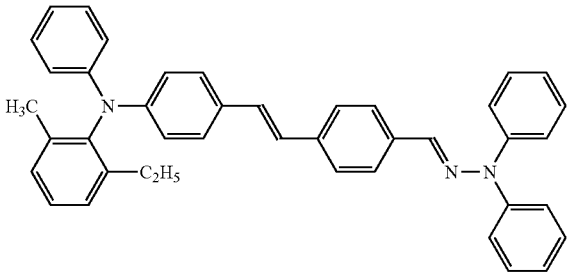

(HTM5-1)

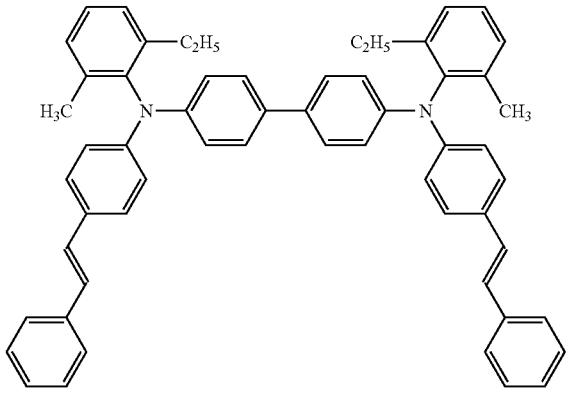

-continued (HTM5-2)

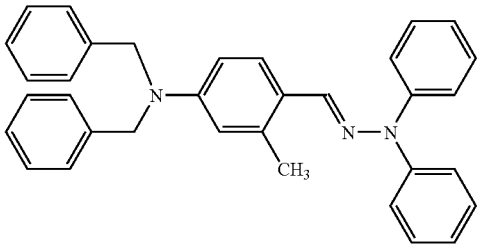

(HTM5-3)

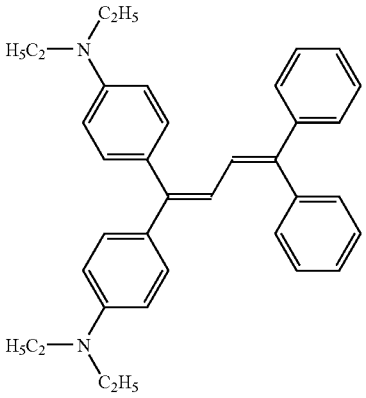

With respect to the single-layer type electrophotosensitive material of Examples 17 to 22 and Comparative Examples 3 to 6, the evaluation for physical properties (measurement of sensitivity upon positive charging and wear amount) was carried out in the same manner as in Example 1. The results are shown in Table 3.

TABLE 3

[Single-layer type photosensitive material]
CGM: CGM1, ETM: ETM14-1

| | Photosensitive layer-forming material | | Evaluation of physical properties | |
|---|---|---|---|---|
| | Binder resin | HTM | Sensitivity upon positive charging (V) | Wear amount (μm) |
| Example 1 | Resin-1 | HTM1-1 | 136 | 1.09 |
| Example 17 | Resin-1 | HTM1-2 | 135 | 1.10 |
| Example 18 | Resin-1 | HTM3-1 | 146 | 1.12 |
| Example 19 | Resin-1 | HTM4-1 | 147 | 1.02 |
| Example 20 | Resin-1 | HTM5-1 | 142 | 1.19 |
| Example 21 | Resin-1 | HTM5-2 | 293 | 1.18 |
| Example 22 | Resin-1 | HTM5-3 | 261 | 1.19 |
| Comparative Example 3 | Resin-4 | HTM5-2 | 280 | 1.62 |
| Comparative Example 4 | Resin-4 | HTM5-3 | 245 | 1.60 |
| Comparative Example 5 | Resin-5 | HTM5-2 | 277 | 1.35 |
| Comparative Example 6 | Resin-5 | HTM5-3 | 244 | 1.39 |

As is apparent from Table 3, the electrophotosensitive materials of all Examples were excellent in sensitivity and durability (wear resistance). To the contrary, the electrophotosensitive materials of all Comparative Examples exhibited large wear amount. Therefore, a difference in wear resistance between the Examples and Comparative Examples was noticeable.

Examples 23 to 26

In the same manner as in Example 1, except that compounds shown in Table 4 were used as the electric charge generating material in place of the compound represented by the formula (CGM1), single-layer type electrophotosensitive materials were produced.

The electric charge generating material (titanyl phthalocyanine) represented by the formula (CGM2) is classified into a so-called Y type compound (CGM2 (Y)) and a so-called α type compound (CGM2 (α)) according to its crystal structure. Y type titanyl phthalocyanine was used in Example 23, while α type titanyl phthalocyanine was used in Example 24. In Example 23, 3.5 parts by weight of CGM2 (Y) and 3.5 parts by weight of an azo pigment (C.I. Pigment 16) represented by the formula (Pig 1) were incorporated.

With respect to the single-layer type electrophotosensitive materials of Examples 23 to 26, the evaluation for physical properties (measurement of sensitivity upon positive charging and amount) was carried out in the same manner as in Example 1. The results are shown in Table 4.

TABLE 4

[Single-layer type photosensitive material]
HTM: HTM1-1, ETM: ETM14-1

| | Photosensitive layer-forming material | | Evaluation of physical properties | |
|---|---|---|---|---|
| | Binder resin | CGM | Sensitivity upon positive charging (V) | Wear amount (μm) |
| Example 1 | Resin-1 | CGM1 | 136 | 1.09 |
| Example 23 | Resin-1 | CGM2 (Y) | 105 | 1.11 |
| Example 24 | Resin-1 | CGM2 (α) | 110 | 1.07 |
| Example 25 | Resin-1 | CGM3 | 112 | 1.09 |
| Example 26 | Resin-1 | CGM4 | 129 | 1.11 |

As is apparent form Table 4, the electrophotosensitive materials of all Examples were excellent in sensitivity and durability (wear resistance).

Example 27

1 Part by weight of Y type titanyl phthalocyanine (CGM2 (Y)) and 1 part by weight of a polyarylate represented by the following formula (resin-7) were added in 48 parts by weight of a solvent (diacetone alcohol) and then dissolved and dispersed using an ultrasonic disperser to obtain a coating solution for formation of an electric charge generating layer.

(resin-7)

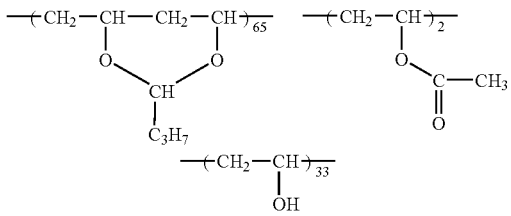

70 Parts by weight of the hole transferring material (HTM1-1), 0.1 parts by weight of the leveling agent (aforementioned "KF-96-50CS") and 100 parts by weight of the binder resin (resin-1) were added in 550 parts by weight of a solvent (tetrahydrofuran) and then dissolved and dispersed using an ultrasonic disperser to obtain a coating solution for formation of an electric charge transferring layer.

First, the coating solution for formation of an electric charge generating layer was applied on an aluminum substrate by a dip coating method and then dried at 50° C. for 30 minutes to form a 0.2 μm thick electric charge generating layer. On the surface thereof, the coating solution for formation of an electric charge transferring layer was applied using a silicone blade and then dried at 110° C. for 45 minutes to form a 30 μm thick electric charge generating layer, and thus a multi-layer type electrophotosensitive material (negative charging type) was obtained.

Examples 28 to 29 and Comparative Example 7 to 9

In the same manner as in Example 27, except that a polyarylate (resin-2) was used as the binder resin in place of the binder resin (resin-1) in Example 28, a polyarylate (resin-3) was used in Example 29, a polyarylate (resin-4) was used in Comparative Example 7, and a polyarylate (resin-5) was used in Comparative Example 8, multi-layer type electrophotosensitive materials were produced.

In Comparative Example 9, a multi-layer type electrophotosensitive material was produced in the same manner as in Example 27, except that a polyvinyl butyral resin (resin-7) was used in place of the binder resin (resin-1) of the coating solution for formation of an electric charge transferring layer.

(Evaluation of Physical Properties)

With respect to the single-layer type electrophotosensitive materials of Examples 27 to 29 and Comparative Examples 7 to 9, the following tests for evaluation of physical properties (3) and (2) were carried out.

(3) Measurement of Sensitivity Upon Negative Charging

An electrophotosensitive material was mounted to an electrostatic copying machine [modified type machine of aforementioned "KM-5530"] and, after charging the surface at −800 V and exposing the surface to red semiconductor laser light having a wavelength of 780 nm, a surface potential (bright potential) was measured.

The value of the surface potential upon exposure may be −90 V or higher.

The results of the evaluation of physical properties with respect to Examples 27 to 29 and Comparative Examples 7 to 9 are shown in Table 5.

TABLE 5

| [Multi-layer type photosensitive material] HTM: HTM1-1 | | | | |
|---|---|---|---|---|
| | Photosensitive layer-forming material | | Evaluation of physical properties | |
| | Binder resin | CGM | Sensitivity upon negative charging (V) | Wear amount (μm) |
| Example 27 | Resin-7, Resin-1* | CGM2 (Y) | −59 | 1.02 |
| Example 28 | Resin-2 | CGM2 (Y) | −63 | 1.14 |
| Example 29 | Resin-3 | CGM2 (Y) | −64 | 1.04 |
| Comparative Example 7 | Resin-4 | CGM2 (Y) | −55 | 1.49 |
| Comparative Example 8 | Resin-5 | CGM2 (Y) | −56 | 1.22 |
| Comparative Example 9 | Resin-7* | CGM2 (Y) | −155 | 6.22 |

*As the binder resin of Example 27, "resin-7" was used in the electric charge generating layer, while "resin-1" was used in the electric charge transferring layer as an outermost layer. In Comparative Example 9, "resin-7" was used as the binder resin in the electric charge generating layer and the electric charge transferring layer.

As is apparent from Table 5, the electrophotosensitive materials of both Examples and Comparative Examples were excellent in sensitivity. With respect to the durability (wear resistance) of the photosensitive layer, the electrophotosensitive materials of the Comparative Examples exhibited large wear amount, while the electrophotosensitive materials of the Examples exhibited very small wear amount. Therefore, a difference in wear resistance between them was noticeable.

Examples 30 to 35 and Comparative Examples 10 to 13

In Examples 30to 35, multi-layer type electrophotosensitive materials were produced in the same manner as in Example 27, except that compounds shown in Table 6 were used as the hole transferring material in place of the compound represented by the formula (HTM1-1).

In Comparative Examples 10 to 13, multi-layer type electrophotosensitive materials were produced in the same manner as in Example 27, except that compounds represented by the formulas (HTM5-2) or (HTM5-3) were used as the hole transferring material and polyarylate (resin-4) or a polycarbonate (resin-5) was used as the binder resin.

With respect to the multi-layer type electrophotosensitive materials of Examples 30 to 35 and Comparative Examples 10 to 13, the evaluation for physical properties (measurement of sensitivity upon negative charging and wear amount) was carried out in the same manner as in Example 27. The results are shown in Table 6.

TABLE 6

| [Multi-layer type photosensitive material] CGM: CGM2 (Y) | | | | |
|---|---|---|---|---|
| | Photosensitive layer-forming material | | Evaluation of physical properties | |
| | Binder resin | HTM | Sensitivity upon negative charging (V) | Wear amount (μm) |
| Example 27 | Resin-1 | HTM1-1 | −59 | 1.02 |
| Example 30 | Resin-1 | HTM1-2 | −62 | 0.95 |
| Example 31 | Resin-1 | HTM3-1 | −64 | 1.03 |
| Example 32 | Resin-1 | HTM4-1 | −66 | 1.05 |
| Example 33 | Resin-1 | HTM5-1 | −67 | 1.07 |
| Example 34 | Resin-1 | HTM5-2 | −93 | 1.15 |
| Example 35 | Resin-1 | HTM5-3 | −93 | 1.17 |
| Comparative Example 10 | Resin-4 | HTM5-2 | −88 | 1.49 |
| Comparative Example 11 | Resin-4 | HTM5-3 | −89 | 1.55 |
| Comparative Example 12 | Resin-5 | HTM5-2 | −92 | 1.23 |
| Comparative Example 13 | Resin-5 | HTM5-3 | −87 | 1.30 |

As is apparent from Table 6, the electrophotosensitive materials of all Examples were excellent in sensitivity and durability (wear resistance). To the contrary, the electrophotosensitive materials of all Comparative Examples exhibits large wear amount. Therefore, a difference in wear resistance between the Comparative Examples and the Examples was noticeable.

Examples 36 and 37

In the same manner as in Example 27, except that compounds shown in Table 7 were used as the electric charge generating material in place of the compound represented by the formula (CGM2 (Y)), multi-layer type electrophotosensitive materials were produced.

In Example 36, α type titanyl phthalocyanine was used.

With respect to the multi-layer type electrophotosensitive materials of Examples 36 and 37, the evaluation for physical properties (measurement of sensitivity upon negative charging and wear amount) was carried out in the same manner as in Example 27. The results are shown in Table 7.

TABLE 7

| [Multi-layer type photosensitive material] HTM: HTM1-1 | | | | |
|---|---|---|---|---|
| | Photosensitive layer-forming material | | Evaluation of physical properties | |
| | Binder resin | CGM | Sensitivity upon negative charging (V) | wear amount (μm) |
| Example 27 | Resin-1 | CGM2 (Y) | −59 | 1.02 |
| Example 36 | Resin-1 | CGM2 (α) | −80 | 1.02 |
| Example 37 | Resin-1 | CGM3 | −71 | 1.00 |

As is apparent from Table 7, the electrophotosensitive materials of all Examples were excellent in sensitivity and durability (wear resistance).

Comparative Examples 14 to 16

In the same manner as in Example 1 in case of Comparative Example 9, Example 17 in case of Comparative Example 10, or Example 21 in case of Comparative Example 11, except that the polyarylate (resin-6) obtained in Comparative Synthesis Example 2 was used as the binder resin in place of the polyarylate (resin-1), single-layer type electrophotosensitive materials were produced.

(Evaluation of Physical Properties)

With respect to the single-layer type electrophotosensitive material of Examples 1, 17 and 21, and Comparatives Example 14 to 16, a test of evaluation for the following physical properties (i) and (ii) was carried out.

(i) Measurement of Change in Charge Amount After Exposure to NOx Gas

Each of electrophotosensitive materials was mounted to an electrostatic copying machine (modified type machine of an electrostatic copying machine manufactured by KYOCERA MITA CORPORATION under the trade name of "Creage7325") and was charged while setting a grid voltage so that a surface potential becomes +800 V. Then, each of electrophotosensitive materials of the respective Examples and Comparative Examples to an NOx gas (24 ppm) atmosphere for 50 hours and the surface potential under the same conditions of the grid voltage set before exposure was measured. Furthermore, a change in surface potential (v) before and after exposure to the NOx gas and the NOx resistance of the electrophotosensitive material was evaluated. For example, if the surface potential before exposure to the NOx gas is 800 V and the surface potential after exposure is 690 V, the change is −110 V. The change in surface potential before and after exposure to the NOx gas may be −150 V or lower (a decrease in surface potential after exposure may be lower than 150 V). When the change exceeds −150V (the change decreases after it exceeds−150V after exposure), it is considered that the electrophotosensitive material is inferior in NOx resistance.

(ii) Change in Properties of Coating Solution After Exposure to NOx Gas

The coating solutions for formation of the photosensitive layer prepared in Examples 1, 17 and 21, and Comparative Examples 14 to 16 were exposed to an NOx gas (24 ppm) atmosphere for 50 hours and, after 3 days have passed since the beginning of the exposure, properties of the coating solution were visually observed.

The results of the evaluation for physical properties with respect to Examples 1, 17 and 21, and Comparative Examples 14 to 16 are shown in Table 8.

TABLE 8

| [Single-layer type photosensitive material] ETM: ETM14-1 | | | | | |
|---|---|---|---|---|---|
| | Photosensitive layer-forming material | | | Evaluation of physical properties: Change in charge | |
| | Binder resin | CGM | HTM | amount after exposure | After 3 days |
| Example 1 | Resin-1 | CGM1 | HTM 1-1 | −51 V | no change |
| Example 17 | Resin-1 | CGM1 | HTM 1-2 | −33 V | no change |

TABLE 8-continued

| [Single-layer type photosensitive material] ETM: ETM14-1 | | | | | |
|---|---|---|---|---|---|
| | Photosensitive layer-forming material | | | Evaluation of physical properties: Change in charge | |
| | Binder resin | CGM | HTM | amount after exposure | After 3 days |
| Example 21 | Resin-1 | CGM2(Y) | HTM 1-1 | −29 V | no change |
| Comparative Example 14 | Resin-6 | CGM1 | HTM 1-1 | −92 V | gelled |
| Comparative Example 15 | Resin-6 | CGM1 | HTM 1-2 | −75 V | gelled |
| Comparative Example 16 | Resin-6 | CGM2(Y) | HTM 1-1 | −61 V | gelled |

As is apparent from Table 8, in the electrophotosensitive materials of the Examples, a change in charge amount after exposure was suppressed and no change in physical properties of the coating solution for formation of a photosensitive layer was observed. To the contrary, in the electrophotosensitive materials of the Comparative Examples, a change in charge amount after exposure was large and, moreover, the coating solution for formation of a photosensitive layer was gelled and large change in physical properties was observed. Therefore, a difference between the Examples and the Comparative Examples was noticeable.

The invention claimed is:

1. An electrophotosensitive material comprising a conductive substrate and a photosensitive layer provided on the conductive substrate, wherein the photosensitive layer contains a polyarylate having a repeating unit represented by the general formula (1):

(1)

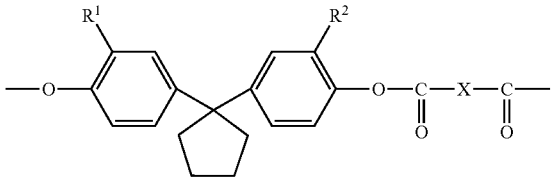

in the formula (1), X represents any of divalent groups represented by the formulas (b) or (c):

(b)

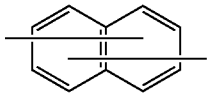

(c)

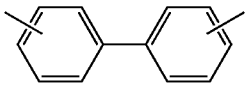

and $R^1$ and $R^2$ are the same or different and represent an alkyl group having 1 to 3 carbon atoms, and a hole transferring material having a triphenylaminostyryl group represented by the general formula (h1):

(h1)

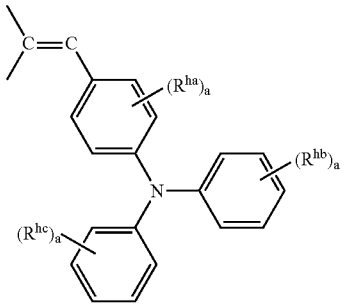

in the formula (h1), $R^{ha}$ and $R^{hc}$ are the same or different and represent an alkyl group having 1 to 8 carbon atoms, an alkoxy group having 1 to 8 carbon atoms, or an aryl group having 12 or less carbon atoms and, in case two or more of the substituents $R^{ha}$ and $R^{hc}$ are substituted on the same benzene ring, the substituents $R^{ha}$ and $R^{hc}$ substituted on adjacent carbon atoms may be combined with each other to form a saturated or unsaturated hydrocarbon ring, and a represents an integer of 0 to 3, in the molecule.

2. The electrophotosensitive material according to claim 1, wherein the substituents $R^1$ and $R^2$ in the repeating unit represented by the general formula (1) are methyl groups.

3. The electrophotosensitive material according to claim 1, wherein the photosensitive layer is a single layer and the layer contains the polyarylate of claim 1 and at least an electric charge generating material and an electric charge transferring material.

4. The electrophotosensitive material according to claim 1, wherein the photosensitive layer is a laminate of two or more layers, and a layer containing the polyarylate of claim 1 among two or more layers is an outermost layer of the photosensitive layer and is a layer containing no electric charge generating material.

* * * * *